United States Patent [19]

Dudt

[11] 4,290,780

[45] Sep. 22, 1981

[54] METHOD FOR GASIFYING FINELY-DIVIDED COAL IN A FIXED BED GASIFIER

[75] Inventor: Philip J. Dudt, Scenery Hill, Pa.

[73] Assignee: Conoco Inc., Stamford, Conn.

[21] Appl. No.: 95,764

[22] Filed: Nov. 16, 1979

[51] Int. Cl.[3] ..... C10J 3/00

[52] U.S. Cl. ..... 48/210; 44/1 F; 44/10 C; 201/31; 201/33; 252/373

[58] Field of Search ..... 44/10 C, 1 B, 1 F, 23, 44/10 R; 252/373; 201/5, 6, 9, 31, 33, 23, 29, 37; 48/210, 203, 206

[56] References Cited

U.S. PATENT DOCUMENTS

| | | | |
|---|---|---|---|
| 1,682,195 | 8/1928 | Sheehan | 44/23 |
| 3,368,012 | 2/1968 | Erickson | 201/5 |
| 3,454,382 | 7/1969 | Hamilton | 201/34 |
| 3,692,505 | 9/1972 | Reichl | 48/206 |
| 4,071,329 | 1/1978 | Eales | 48/62 R |
| 4,073,627 | 2/1978 | Anderson | 48/62 R |
| 4,078,903 | 3/1978 | Eales | 48/62 R |

OTHER PUBLICATIONS

Struck et al., "Small Continuous Unit for Fluidized Coal Carbonization", *I&EC Process Design and Development*, vol. 6, p. 85, Jan. 1967.

*Primary Examiner*—S. Leon Bashore
*Assistant Examiner*—Michael Goldman
*Attorney, Agent, or Firm*—F. Lindsey Scott; William A. Mikesell, Jr.

[57] ABSTRACT

A process for gasifying finely-divided coal in a fixed bed gasifier, the process comprising: charging finely-divided coal to a stirred semi-fluidized carbonizer reaction zone where the coal is contacted with oxygen and agglomerated into coal derived particulate solids of a size suitable as a feedstock to a fixed bed gasifer and thereafter passed to a fixed bed gasifer.

7 Claims, 1 Drawing Figure

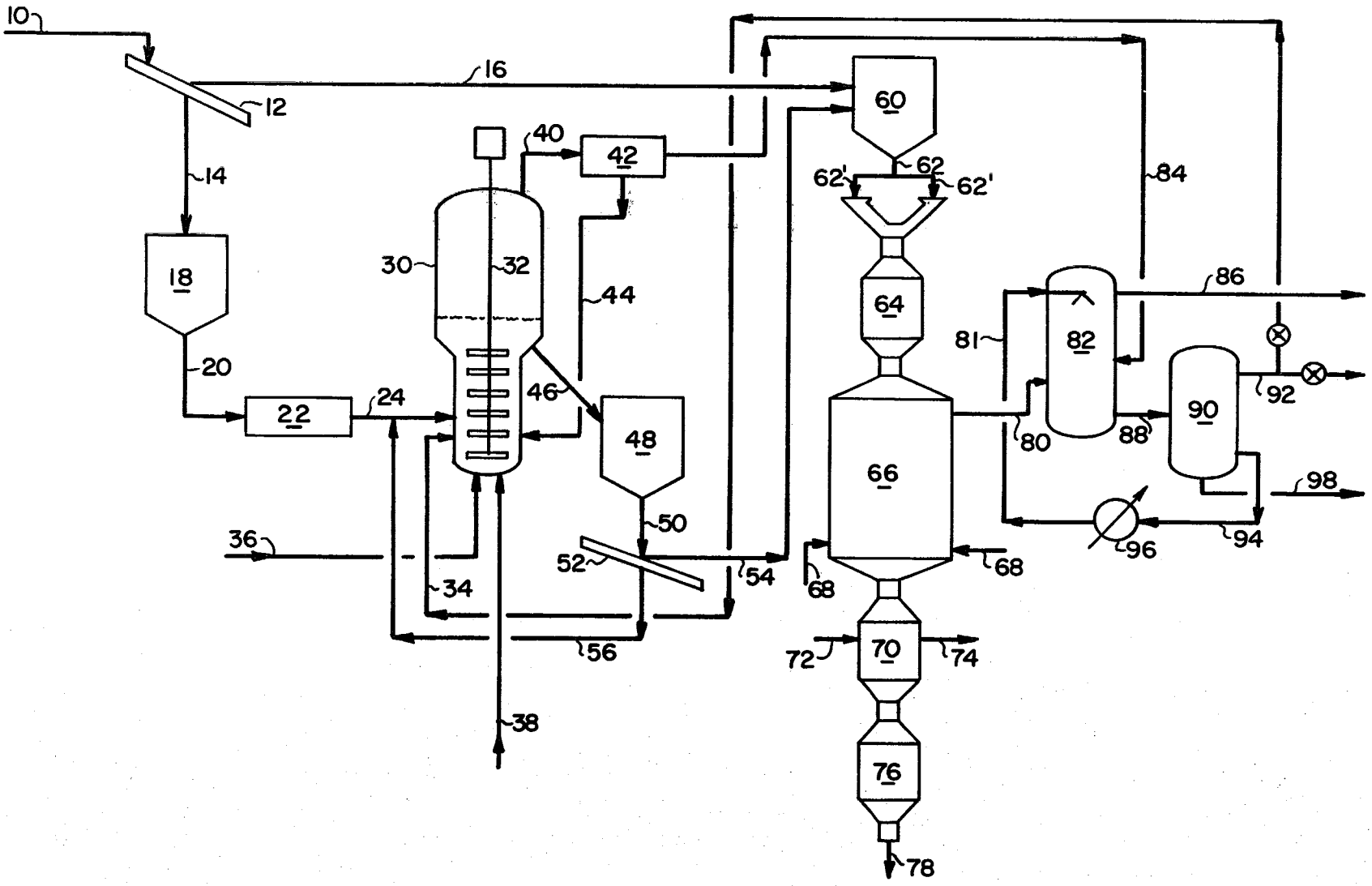
10
12
14
16
18
20
22
24
30
32
34
36
38
40
42
44
46
48
50
52
54
56
60
62
62'
64
66
68
70
72
74
76
78
80
81
82
84
86
88
90
92
94
96
98

METHOD FOR GASIFYING FINELY-DIVIDED COAL IN A FIXED BED GASIFIER

This invention relates to the gasification of finely-divided coal in fixed bed gasifiers.

This invention further relates to a process for gasifying finely-divided coal in fixed bed gasifiers by charging the finely-divided coal to a stirred semi-fluidized carbonizer reaction zone where the coal is formed into particulate solids of a size suitable for use as a feedstock in fixed bed gasifiers.

In recent years a considerable amount of effort has been directed to the development of processes whereby coal and other non-petroliferous hydrocarbon fuels can be converted into synthetic fuels such as synthetic natural gas. One approach used to produce such synthetic natural gas is the use of fixed bed gasifiers either of the dry bottom or slagging type. Some slagging gasifiers are shown in U.S. Pat. No. 4,071,329 issued Jan. 31, 1978, U.S. Pat. No. 4,073,627 issued Feb. 14, 1978 and U.S. Pat. No. 4,078,803 issued Mar. 14, 1978. These references are hereby incorporated in their entirety by reference. Dry bottom fixed bed gasifiers are well known to the art also and both types of fixed bed gasifiers are adapted to the use of the particulate coal derived solids produced by the process of the present invention. The operation of stirred semi-fluidized carbonizers has been described in an article entitled, "Small Continuous Unit for Fluidized Coal Carbonization," Robert T. Struck, Philip J. Dudt and Everett Gorin, I & EC Process Design and Development, Volume 6, p.85, January 1967. This reference discusses a laboratory scale unit for the production of low solids tars from coal.

In a prior art search conducted on the concept of the subject invention, the following references were discovered:

| | | |
|---|---|---|
| U.S. PAT. NO. | 1,723,932 | Greene et al. |
| | 2,502,141 | Galusha |
| | 3,454,382 | Hamilton |
| | 3,047,472 | Gorin et al. |

These references are hereby incorporated by reference.

In the use of fixed bed gasifiers, it is highly desirable that the entire run of mine coal stream typically produced be usable as a feedstock. In other words, most fixed bed gasifiers require a particulate feedstock of a size consist greater than about ¼ inch. The size range normally used is from about ¼ inch to about 1¼ inch. In many mining operation the run of mine coal stream produced contains a large amount of finely-divided coal, i.e. coal less than a size consist of about ¼ inch. Such finely-divided coal can be charged in small quantities to fixed bed gasifiers, but when substantial amounts are charged, the finely-divided coal tends to be carried out of the reaction zone prior to reaction by the gas velocity in the fixed bed gasifier. As a result, a continuing search has been directed to methods whereby finely-divided coal can be charged to fixed bed gasifiers.

By the process of the present invention, finely-divided coal is charged to a stirred carbonizer reaction zone where it is contacted with a free oxygen containing gas to maintain a suitable reaction temperature in a stirred semi-fluidized bed maintained in a semi-fluidized condition by an inert sweep gas and a stirrer to produce a particulate coal derived solids stream which is of a size consist suitable for use as a fixed bed gasifier feedstock.

The FIGURE is a schematic diagram of an embodiment of the process of the present invention.

In the FIGURE, a run of mine coal stream is passed to the process through a line 10 and charged to a screen 12 where the stream of coal is separated into a particulate coal stream of a size consist suitable for use as a fixed bed gasifier feedstock which is passed to a gasifier feedstock storage 60 and an undersized particulate coal stream of a size consist less than about ¼ inch which is recovered through a line 14 and passed to a fine coal storage vessel 18. Finely-divided coal is fed from storage 18 through a line 20 through a heater 22 and a line 24 to a stirred semi-fluidized carbonizer vessel 30. Vessel 30 is stirred by a stirrer 32 and a fluidizing gas is charged to vessel 30 through a line 38 with a free oxygen containing gas being charged to vessel 30 through a line 36. A gaseous overhead stream is recovered from vessel 30 through a line 40 and passed to a gas-solids separator 42, such as a filter, cyclone or the like to remove entrained solids from the gaseous stream. The entrained solids are recycled through a line 44 to vessel 30. A particulate solids stream, at least a portion of which is of a size consist suitable for use as a fixed bed gasifier feedstock, is recovered from vessel 30 through a line 46 and passed to a storage vessel 48. Such solids are passed from storage 48 to a screen 52 via a line 50. At screen 52, the stream of particulate solids is separated into a stream of a size consist suitable for use as a fixed bed gasifier feedstock which is passed through a line 54 to gasifier feedstock storage 60 and an undersized stream which is recovered through a line 56 and passed to vessel 30 via a line 56 and line 24. The coal and particulate solids feedstock to a gasifier vessel 66 from feedstock storage 60 is passed through a line 62 and lines 62' to a lockhopper 64 from which it is charged to gasifier vessel 66 at a measured rate to produce a synthesis gas stream and an ash underflow. The ash underflow may be liquid when a slagging gasifier, as shown, is used or particulate solids when a dry bottom gasifier is used. A free-oxygen containing gas is injected through lines 68 to gasify the coal in gasifier 66 with slag being recovered in a slag cooler 70 which is cooled by water injected through a line 72 and recovered through a line 74 to produce a particulate slag which is recovered in a lockhopper 76 and discharged through a line 78. The operation of slagging gasifier 66 has not been described in detail since it is discussed in some detail in the references incorporated previously by reference and since the operation of such gasifiers is considered to be known to those in the art. The synthesis gas stream so produced is recovered through a line 80 and passed to a scrubber 82 where the gaseous mixture is countercurrently contacted with water supplied through a line 81 to produce a scrubbed synthesis gas stream which is recovered through a line 86 and passed to further processing. An aqueous stream is recovered from scrubber 82 via a line 88 and passed to a separator 90 from which an aqueous stream is withdrawn through a line 94, a tar stream is withdrawn through a line 92 and a solids stream is withdrawn through a line 98. The aqueous stream withdrawn through line 94 is passed through a heat exchanger 96 to line 81 as a water recycle to scrubber 82. The solids stream recovered through line 98 is passed to waste, further processing or the like and optionally a portion of the tar stream recovered through line 92 is recycled via a line 34 to carbonizer 30. The gaseous stream produced from carbonizer 30 via line 40 is passed through a line 84 to processing in scrubber 82 with the synthesis gas mixture produced from gasifier 66.

In the practice of the process of the present invention, carbonizer 30 is operated at a temperature from about 950° to about 1200° F. The temperature in carbonizer 30 is maintained by controlling the amount of free oxygen containing gas injected. The free oxygen containing gas may be oxygen, oxygen enriched air, air or the like as known to those in the art. Desirably, the temperatures are in excess of about 1000° F. since at the higher temperatures more tar is produced in the gaseous stream recovered through line 40 which is passed to tar recovery and the like. The tar so recovered is typically quite low in solids since the particulate solids have been removed in filter 42 and are further removed via line 98 from separator 90. Desirably the coal charged to carbonizer 30 via line 24 is of a size consist smaller than about minus 8 Tyler mesh and preferably is smaller than about minus 14 Tyler mesh. It may be desirable in some instances to grind the coal prior to charging it to carbonizer 30. In other words, the underflow from screen 12 may be of a size consist up to about ¼ inch and desirably a smaller particle size is charged to carbonizer 30. Accordingly, it may be found desirable to grind the coal to the smaller size consist prior to charging it to carbonizer 30.

When caking coals are used, the air injection to carbonizer 30 not only serves to maintain the temperature in carbonizer 30, but also serves to decake coal.

When non-caking or semi-caking coals are charged to carbonizer 30 it has been found desirable to inject a carbonaceous binder via line 34 to facilitate the agglomeration of the finely-divided non-caking or semi-caking coal into particulate solids of a suitable size. The carbonaceous binder is desirably added in an amount less than about 15 weight percent based on the weight of moisture and ash free coal charged to vessel 30 with a preferable range being about 10 to 12 percent. Desirably tar is used as the carbonaceous binder in vessel 30 and comprises a recycle stream from the gas processing plant which is shown as a portion of the stream produced in separator 90 and recovered through line 92. Desirably the carbonaceous binder is a material having a boiling point above about 700° F. The sweep gas used in vessel 30 is desirably supplied in an amount sufficient to provide a linear gas velocity in vessel 30 from about 0.1 to about 0.5 feet per second. Such gas flows typically will result in the use of from about 5 to about 25 standard cubic feet of sweep gas per pound of moisture and ash free coal feed. A preferable range is from about 5 to about 15 standard cubic feet per pound of moisture and ash free feed. Typical solids residence times in vessel 30 are from about 30 to 60 minutes. The resulting solids stream recovered by overflow from vessel 30 through line 46 contains a substantial amount of particulate solids of a size consist suitable for use as a feed stock to a fixed bed gasifier. The stream is desirably separated into a portion of a suitable size consist for use as a fixed bed gasifier feedstock and an underflow stream which is recycled to vessel 30.

By the process of the present invention, finely-divided coal is processed prior to charging to a fixed bed gasifier to convert the finely-divided coal into a form suitable for use as a feedstock to a fixed bed gasifier. Further advantages are also accomplished by the process of the present invention. In particular, the particulate coal derived solids produced in the stirred carbonizer are relatively low in tar and reduce the amount of tar produced in gasifier 66. The presence of tars in gasifier 66 is undesirable since various operational problems arise when coal feedstocks which result in the production of substantial tar in synthesis gas stream 80 are used. The gaseous streams produced in carbonizer 30 are readily processed in the same gas treatment plant used by gasifier 66 and further the process results in the production of substantial quantities of a relatively low solids tar stream which is desirable as a by-product stream for the production of tar acids, for use as a heavy fuel oil, as a hydrocracker feedstock and the like. Further, the treatment of the coal in vessel 30 results in the production of a high Btu gaseous stream which is recovered through a line 40 and may be added to the synthesis gas stream produced in gasifier 66.

In the operation of vessel 30, the use of the sweep gas at the velocity stated in conjunction with stirring has been found to result in the presence of a semi-fluidized highly agitated bed of particulate solids in vessel 30. The sweep gas may be any suitable inert gaseous stream such as the gaseous stream flowing through line 84, the synthesis gas stream flowing through line 86, nitrogen or the like. The operation of vessel 30 in this fashion, results in the production of hard, dense particulate solids suitable for use as a fixed bed gasifier feedstock from the finely-divided coal.

Having thus described the invention by reference to certain of its preferred embodiments, it is pointed out that the embodiments described are illustrative rather than limiting in nature and that many variations and modifications are possible within the scope of the present invention. Such variations and modifications may be considered obvious and desirable by those skilled in the art upon a review of the foregoing description of preferred embodiments.

Having thus described the invention, I claim:

1. A process for gasifying finely-divided coal in a fixed bed gasifier, said process comprising (a) charging said finely-divided coal to a stirred semi-fluidized carbonizer reaction zone;

(b) charging a free oxygen containing gas to said reaction zone in an amount sufficient to maintain a temperature in said reaction zone from about 950° to about 1200° F.;

(c) charging an inert sweep gas to said reaction zone at a rate sufficient to provide a linear gas velocity in said reaction zone from about 0.1 to about 0.5 feet per second;

(d) recovering a gaseous stream from said reaction zone;

(e) recovering a particulate coal derived solids stream, at least a portion of said particulate solids stream being of a size consist greater than about ¼ inch for use as a feedstock to a fixed bed gasifier from said reaction zone; and (f) charging at least said portion of said particulate solids stream to a fixed bed gasifier to produce a gaseous stream and an ash stream.

2. The process of claim 1 wherein said coal is a caking coal.

3. The process of claim 1 wherein said coal is a non-caking coal or a semi-caking coal and wherein a carbonaceous binder is charged to said reaction zone.

4. The process of claim 3 wherein said gaseous stream from said reaction zone and said gaseous stream from said gasifier are passed to further treatment to produce a low solids tar stream and a gaseous stream.

5. The process of claim 4 wherein a portion of said low solids tar stream is recycled to said reaction zone as said carbonaceous binder.

6. The process of claim 1 wherein said particulate coal derived solids stream is separated into said portion of a size consist suitable for use as a feedstock to a fixed bed gasifier and an undersize portion.

7. The process of claim 6 wherein said undersize portion is recycled to said reaction zone.

* * * * *